United States Patent [19]

Hooper et al.

[11] Patent Number: 4,881,465

[45] Date of Patent: Nov. 21, 1989

[54] NON-TOXIC SHOT PELLETS FOR SHOTGUNS AND METHOD

[76] Inventors: Robert C. Hooper, 16209 Congo La., Houston, Tex. 77040; Franz R. Brotzen, 2701 H Bellefontaine, Houston, Tex. 77025

[21] Appl. No.: 239,310

[22] Filed: Sep. 1, 1988

[51] Int. Cl.[4] ..... F42B 5/24

[52] U.S. Cl. ..... 102/501; 102/448; 102/517; 75/0.5 BA; 419/33

[58] Field of Search ..... 102/501, 448, 517, 516; 419/33; 75/0.5 BA

[56] References Cited

U.S. PATENT DOCUMENTS

| | | | |
|---|---|---|---|
| 1,703,577 | 2/1929 | Falkenberg | 420/515 |
| 2,167,828 | 8/1939 | Dowdell et al. | 102/459 |
| 3,363,561 | 1/1966 | Irons | 102/459 |
| 3,900,317 | 8/1975 | Meadus et al. | 419/1 |
| 3,987,730 | 10/1976 | Meadus et al. | 102/42 |
| 4,383,853 | 5/1983 | Zapffe | 75/122.7 |
| 4,428,295 | 1/1984 | Urs | 102/448 |

*Primary Examiner*—Stephen J. Lechert, Jr.
*Assistant Examiner*—Ngoclan Mai
*Attorney, Agent, or Firm*—Epstein, Edell & Retzer

[57] ABSTRACT

A non-toxic shotgun pellet having ballistic characteristics similar to those of lead shot is made up of particles of a first alloy, containing primarily ferrotungsten, suspended in a matrix of a second alloy, containing primarily lead. The relative amounts of lead and ferrotungsten are selected to minimize cost while keeping the overall lead content to forty percent or less, by weight, to avoid toxicity. The first alloy is formed by diluting the ferrotungsten with iron or steel and carbon at temperatures on the order of 1800° C. in an inert gas environment. The alloy is quenched and then crushed into particles over which is poured the second alloy comprising lead, tin and antimony in order to suspend the first alloy particles in the second alloy mixture.

14 Claims, 1 Drawing Sheet

NON-TOXIC SHOT PELLETS FOR SHOTGUNS AND METHOD

BACKGROUND OF THE INVENTION

1. Technical Field

The present invention relates to pellets for shotgun ammunition and, more particularly, to metal combinations for such pellets which are non-toxic yet have specific gravities which are comparable to conventional toxic lead pellets, are safe to reload, and minimize damage to the barrel of a shotgun.

2. Discussion of the Prior Art

There has been considerable commentary in the literature concerning the problem of lead poisoning in waterfowl. Specifically, ducks and geese, as they feed along coastal regions, often swallow and ingest spent lead shot pellets. The ingested pellet or pellets are conveyed with other swallowed food and material to the bird's gizzard which grinds up the material as the first step in the digestion process. The lead pellet is eroded and provides a soluble lead salt that is passed into the digestive system. It has been found that the lead salt causes severe anemia and significantly limits the ability of the bird's blood to provide oxygen and nutrition to the body, resulting in a loss of appetite that weakens the bird to the point where it eventually dies or is eaten by a predator. Consequently, lead shot has been prohibited in certain areas of the United States.

The only commercially available alternative to lead shot at the present time is steel shot. There are, however, three significant problems associated with steel shot. One of these problems derives from the low specific gravity of steel, namely 7.9 g/cc, relative to the 11.3 g/cc specific gravity of lead. This lower density or specific gravity results in a lower kinetic energy and concomitant reduced killing power for steel than for lead for a given diameter and configuration of pellet. This fact is illustrated in FIG. 1 of the accompanying drawing wherein kinetic energy of a pellet versus distance of shot trajectory is graphically shown for two sizes of pellets, namely #2 steel and #2 lead or lead equivalent, and #4 steel and #4 lead, or lead equivalent. For example, at forty yards using #2 size shot, the lead shot has 8.2 ft/lbs of kinetic energy whereas the steel shot has only 5.8 ft/lbs, an energy difference of approximately thirty percent. If an arbitrary energy level (e.g., 2.5 ft/lbs) is established at which a shot pellet will clearly kill a bird rather than merely cripple it, it is clear from FIG. 1 that the #4 steel shot would be ineffective beyond forty-eight yards, whereas the #4 lead shot would effect a clean kill at up to sixty yards. The foregoing compares steel with pure lead; however, it should be noted that most "lead" shot sold commercially is actually ninety-four percent lead (Pb), by weight, and six percent antimony (Sb) by weight, resulting in a specific gravity of 11.1 g/cc. This small difference in density does not affect the foregoing analysis.

In order to compensate for this problem, manufacturers of steel shot recommend that waterfowl hunters use steel shot that is two sizes larger than the lead shot they would normally use. In other words, the larger size pellets have greater mass and therefore have higher kinetic energy. For example, if a hunter uses #6 lead shot for duck hunting, #4 steel shot would be recommended as a replacement. However, there are fewer pellets of the #4 steel shot than in the #6 lead shot resulting in a relatively low pattern density (i.e., number of pellets per unit area) at a range of sixty yards. In this regard, denser pellet patterns result in clean kills whereas the less dense patterns tend only to cripple. From a humane approach, the less dense patterns are obviously undesirable.

A second problem associated with steel shot is that components and data for reloading steel pellets into shot shells are not currently available to the hunter. The personal reloading of one's own shotshells is a widely practiced craft among American waterfowl hunters. In addition to the absence of reloading data for steel, there can be a safety problem in improperly reloading the steel shot. Since steel does not deform at all, it requires a slow-burning powder to prevent build-up of excessive gun chamber pressure. Therefore, gun chamber explosions can occur from incorrect loading.

A third problem associated with steel shot arises when the steel pellets are shot through a chromium or steel shotgun barrel. The steel pellets tend to wear the barrel, particularly the choke. It is far more desirable, therefore, to have shot pellets which are made of a softer and more malleable metal so as not to wear and erode the barrel.

Basically, there are three approaches to solving the problem of lead poisoning in waterfowl. These are: (1) providing a disintegratable lead shot which would fragment in water and thus become unavailable for ingestion; (2) coating the pellet to prevent absorption of ingested pellets into the system; and (3) replacing the lead with a less toxic metal or alloy. Disintegratable lead shot suffers from storage problems in that moisture tends to cause premature disintegration. Further, the trajectory characteristics of such shot are erratic. On the other hand, coating the pellets has proven to be ineffective as the coating quickly is abraded away in the gizzard environment.

Replacement metals and alloys have met with little success in the prior art. For example, in U.S. Pat. No. 1,703,577 (Falkenberg), a technique is described whereby metallic tungsten (W) is dissolved in alloys of lead and antimony, or in alloys of zinc, lead and iron (Fe). There is no discussion in the patent of any relationship between specific gravity and kinetic energy, and no reference to toxicity. Permissible lead content of the alloy ranges up to eighty percent by weight which is far beyond the maximum of approximately forty percent required to avoid toxicity.

In U.S. Pat. No. 2,167,828 (Dowdel et al), a technique is described for reducing lead poisoning in waterfowl by alloying small amounts of either magnesium, zinc, lithium, sodium, barium, potassium or calcium with lead (approximately ninety-six percent lead). These minor additives are provided for the express purpose of hastening the decomposition of the lead alloy in aqueous solution. The patent also describes a copper coating for preventing the same decomposition in a bird's "moist flesh". The resulting alloy, however, is still highly toxic due to the relatively high lead content.

U.S. Pat. No. 3,363,561 (Irons) discloses a shot gun pellet constructed of an iron core with numerous optional plastic coatings for reducing barrel wear. The resulting pellet has considerably lower specific gravity than a lead pellet.

In U.S. Pat. No. 3,900,317 (Meadus et al), a process for forming shot using iron, lead, tin (Sn), copper and zinc is described. However, powder metallurgy is employed whereby sintered composite powders are packed in graphite and sintered at about 1,000° C. Typically, the alloys described have specific gravities on the order of 7.5 g/cc which is not an improvement, even with respect to steel shot. Moreover, the fifty-five percent by weight content of lead is considered toxic to waterfowl. The complicated and expensive powder metallurgy process, and lack of alloy density, preclude commercial viability of the alloy.

U.S. Pat. No. 4,383,853 (Zapffe) discloses a technique whereby depleted uranium is alloyed with iron and chromium at a temperature below 1535° C. Although uranium and its salts are quite toxic, it is stated in the patent that chromium will render the uranium harmless by forming a "stainless steel-like matrix". These alloys require high temperature to fabricate and result in an associated high energy cost. The alloys also achieve a specific gravity of 8.4 g/cc, which is only seventy-four percent of that of lead. No mention is made in the patent of hardness of the material or of potential shotgun wear, but if the alloy lies midway in the stated concentration ranges, it should have a hardness of 400 brinell, or greater, and would definitely cause barrel erosion.

Finally, the cost of the individual elements must be given over-riding consideration in formulating any alloy, including alloys utilized in forming shotgun pellets.

OBJECTS AND SUMMARY OF THE INVENTION

It is therefore an object of the present invention to provide a non-toxic and relatively inexpensive alloy suitable for use as shotgun pellets and having a specific gravity similar to that of lead.

It is another object of the present invention to provide a non-toxic alloy suitable for use as shotgun pellets that can be safely hand-loaded using existing reloading data for lead shot.

Another object of the present invention is to provide a nontoxic alloy suitable for use as shotgun pellets that create optimal pellet pattern densities upon being fired.

It is also an object of the present invention to provide a non-toxic alloy suitable for use as shotgun pellets which will not erode or wear away the barrel of a shotgun.

It is still a further object of the present invention to provide a non-toxic alloy suitable for use as shotgun pellets that achieve sufficient kinetic energy to kill cleanly, rather than cripple, waterfowl.

In accordance with the present invention a first alloy of iron, ferrotungsten alloy, and carbon is crushed into small particles and suspended in a matrix of a second alloy of lead, tin and antimony. The resulting material is then made into shot spheres and typically has a specific gravity in the range of 9.5 to 11.5 g/cc. Except for lead and antimony, none of the other elements employed in the final material are considered toxic. The percentage of lead, by weight, in the pellets thusly formed is in the range of fifteen to forty percent, preferably in the more limited range of twenty to thirty-five percent, substantially below toxicity levels. The preferred range of antimony content by weight is 0.02 to seven percent, also far below toxicity levels. As a consequence, spent shot pellets made of this material present no toxicity hazard to feeding waterfowl.

The ferrotungsten alloy, present in the range of twelve to twenty-five percent, by weight, is employed to compensate for the loss of density (i.e., lowered specific gravity) resulting from reducing the lead content from that of prior art shotgun pellet materials. The specific gravity of the final material is thus approximately the same as that of lead shot, thereby permitting the shot pellets of the present invention to achieve the same trajectory pattern densities achieved by lead pellets. The precise content of lead versus ferrotungsten within the stated ranges will vary wit the cost of those materials. Ferrotungsten alloy tends to be relatively expensive and its cost will have to be balanced against the toxicity of the lead in choosing the relative amounts of ferrotungsten alloy and lead necessary to maintain the specific gravity of the final material in the preferred range of approximately 9.5 to 11.5 g/cc.

The kinetic energy or killing power of the shotgun material of the present invention allows the shot pellets to kill cleanly, rather than cripple. In addition, the material has minimum deformation as it leaves the barrel as compared to lead shot. The rigidity afforded by the ferrotungsten alloy limits the deformation.

The alloy of the present invention can be safely hand-loaded by the reloader since existing data and charts on shot loads and powder for lead can be used. Another advantage of the alloy over lead shot is that, because there is less shot loss due to fewer lost stray pellets from deformation; and, thus, less shot is required to achieve the same pattern density.

Since the hardness of the alloy of the present invention is intermediate lead and tungsten, less wear of the shotgun barrel results. If desired, the alloy sphere may be copper plated to ensure against barrel wear. If required to promote adherence, a thin layer of electrolessly plated nickel may be interposed between the alloy and the copper.

BRIEF DESCRIPTION OF THE DRAWINGS

These and other objects, features and many of the attendant advantages of the present invention will be better understood upon reading the following detailed description considered in connection with the accompanying drawings, wherein.

DESCRIPTION OF THE PREFERRED EMBODIMENT

The composition of the present invention requires formation of two alloys. The first alloy is made up of ferrotungsten alloy (FeW), iron (or steel) and carbon. Typically, the content of tungsten in the starting ferrotungsten alloy is eighty percent by weight, and the ferrotungsten alloy has a specific gravity of 17.0 g/cc. The ferrotungsten alloy is diluted with iron (or steel) to obtain an homogeneous alloy having a specific gravity of approximately 10.5 g/cc, a result readily achieved using seventy parts by weight iron (or steel) and twenty-nine parts by weight ferrotungsten alloy. This procedure is best accomplished in induction melting apparatus, capable of achieving temperatures of about 1800° C., because of the stirring motion afforded by the electrodynamic forces in this process. Added during formation of this first alloy is one part, by weight, carbon, in the form of carbon black or graphite, to render the resulting alloy sufficiently brittle to permit it to be crushed into small fragments. An inert gas (e.g., nitrogen, argon, etc.) environment surrounds the alloy crucible during formation of the first alloy to prevent loss of tungsten by formation of volatile tungsten oxides. After alloying is completed the material is poured (i.e., pigged) in such a way as to effect quenching while avoiding phase segregation.

The iron-ferrotungsten-carbon alloy is crushed into small particles by means of a ball mill or other appropriate conventional industrial technique. The resulting powder is then categorized into standard particle size distributions by a set of conventional sieves. Desirable particle sizes are collected for use in the final material; undesirable particle sizes are recycled starting with the initial alloying cycle step. Desired particle sizes are required to be small in relation to the shot size to be prepared so that multiple particles can be employed in each pellet.

The second alloy employed in the final material is a mixture made up of eighty parts by weight lead, fourteen parts by weight tin and six parts by weight antimony. The mixture is heated to approximately 300° C. to permit the mixture to melt and alloy together homogeneously. The lead-tin binary liquidus for this combination is 295° C. The elements chosen for this second alloy are selected to provide the alloy with a specific gravity of 10.5 g/cc, the same as the specific gravity of the iron-ferrotungsten-carbon alloy.

Figure 1:
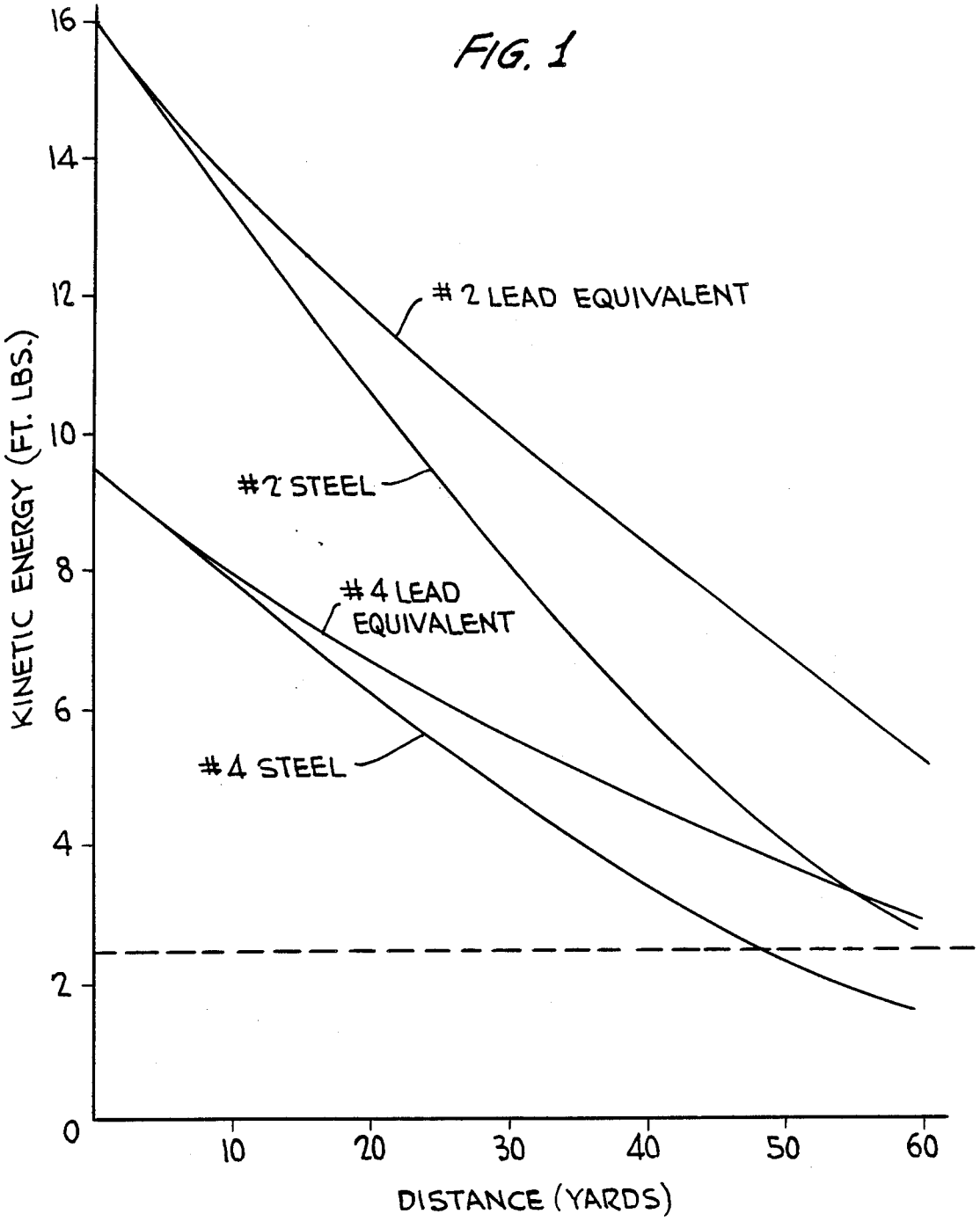
FIG. 1 is a plot of pellet kinetic energy versus range or distance for four different pellet compositions and sizes.
Figure 2:
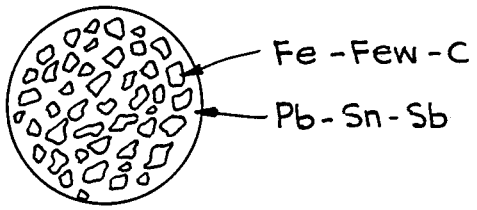
FIG. 2 is a diagrammatic illustration of a shotgun pellet formed in accordance with the principles of the present invention.

The lead-tin-antimony alloy, in molten form, is poured over pre-measured iron-ferrotungsten-carbon alloy particles which are wetted by the molten alloy and become suspended in a matrix of that alloy. Conventional fluxes may be employed to accelerate and assure complete wetting. The resulting suspension can be treated in a manner quite similar to that in which conventional lead shot pellets are formed. In this manner the material can be inexpensively formed into spheres of appropriate diameter for the different shot sizes. For example, the Bleimeister shot-making machine may be employed to form the desired shot pellets. FIG. 2 is an illustration of a typical shot pellet formed from the material of the present invention wherein the particles of the iron-ferrotungsten-carbon alloy are suspended in a matrix of a lead-tin-antimony alloy.

Table I provides a comparison of the lead content and the materials cost, per pound, for different ratios of the first alloy (iron-ferrotungsten-carbon) to the second alloy (lead-tin-antimony) in the final material. The cost per pound is based on prices quoted as of a particular date and, of course, will vary from time to time; nevertheless, it serves as a useful relative reference in forming the final material.

TABLE I

| Fe—FeW—C Pb—Sn—Sb (Ratio) | Lead Content | Material Cost Per Pound |
|---|---|---|
| 1:1 | 40% | $ 1.02 |
| 1.4:1 | 33% | 1.06 |
| 2:1 | 27% | 1.10 |
| 3:1 | 20% | 1.15 |

Since it has been determined that shot material having forty percent lead by weight is borderline in terms of toxicity, the preferred lead content should be in the twenty percent to thirty-five percent by weight range, with a view toward optimally balancing toxicity against cost. However, if substantial quantities of scrap ferrotungsten can be obtained to significantly reduce cost, it would be desirable to provide lead in amounts of twenty percent or less, by weight.

It is believed that the relatively hard iron-ferrotungsten-carbon alloy does not abrade and wear steel gun barrels; however, if this is a concern, the composite spherical shot pellets may be electroplated with copper, nickel or lead (or alloys thereof) to ensure against such erosion. All of these metals have sufficiently high specific gravity so as not to negatively impact on the kinetic energy of the pellet, and are sufficiently soft so as not to wear away the barrel of a shotgun.

It has been found that the useful range of compositions, by weight, for the final shot material is as follows: lead 15–40%; in 2–14%; ferrotungsten 12–25%; iron 35–54%; antimony 0.02–7% and carbon 0.5–2%. Making cost calculations for a range of specific gravity and a range of lead content, it appears that 30% + (or minus) 5% lead, at a specific gravity of 10.5 g/cc, is a somewhat optimum compromise.

It should be noted that impurities normally found in the iron or ferrotungsten alloy (e.g., nickel, copper, niobium, molybdenum, tantalum, chromium and cobalt) do not affect the method described for preparing the final shot material.

The specific gravity for the final material of the present invention is considerably closer to lead-antimony shot material than is the specific gravity of steel. The ballistic properties of the shot pellets made from the material of the present invention are, therefore, approximately the same as those for the lead-antimony shot.

The alloy of the present invention can be safely hand-loaded by the reloader since existing data and charts on shot loads and powder for lead may be utilized. Another advantage of the alloy of the present invention over lead shot arises because there is no shot loss due to deformation caused by stray pellets so that less shot is required to achieve the same pattern.

From the foregoing description it will be appreciated that the invention makes possible a novel composition of material for forming shotgun pellets having characteristics substantially similar to lead shotgun pellets without the toxicity levels of lead pellets.

Having described a preferred embodiment of a new and improved composition of material for forming shotgun pellets, and method for forming that material, in accordance with the present invention, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A non-toxic shotgun pellet comprising the following components:
   - a first alloy containing primarily a ferrotungsten alloy;
   - a second alloy containing primarily lead;
   - wherein said first alloy is in the form of particles suspended in a matrix of said second alloy;
   - wherein the concentration of lead in said pellet is no greater than forty percent by weight; and
   - wherein the specific gravity of said pellet is at least 9.5 grams per cubic centimeter.

2. The shotgun pellet according to claim 1 wherein said ferrotungsten alloy is approximately eighty percent by weight tungsten and has a specific gravity of approximately 17.0 grams per cubic centimeter.

3. The shotgun pellet according to claim 2 wherein said first alloy essentially comprises: seventy percent by weight of ferrotungsten alloy; twenty-nine percent by weight of iron or steel; and one percent by weight of carbon.

4. The shotgun pellet according to claim 3 wherein said second alloy essentially comprises: eighty percent by weight of lead; fourteen percent by weight of tin; and six percent by weight of antimony.

5. The shotgun pellet according to claim 1 wherein the specific gravities of said first and second alloys are substantially equal.

6. The shotgun pellet according to claim 5 wherein the specific gravity of said first and second alloys is approximately 10.5 grams per cubic centimeter.

7. The shotgun pellet according to claim 1 wherein said first alloy comprises: iron, said ferrotungstein alloy, and carbon; wherein said second alloy comprises: lead, antimony and tin; such that the overall composition of said pellet comprises, by weight: lead, 15–40%; tin, 2–14%; ferrotungsten alloy, 12–25%; iron, 35–54%; antimony, 0.02–7%; and carbon, 0.5–2%.

8. The shotgun pellet according to claim 7 wherein the specific gravity of said pellet is approximately 10.5 grams per cubic centimeter.

9. The shotgun pellet according to claim 1 wherein said second alloy essentially comprises: eighty percent by weight of lead; fourteen percent by weight of tin; and six percent by weight of antimony.

10. The method of preparing material from which shotgun pellets are to be formed, said method comprising the steps of:

(a) preparing a first alloy by diluting a ferrotungsten alloy with iron or steel and carbon to obtain a homogenous alloy;

(b) crushing the first alloy into particles that are very much smaller than the shotgun pellets to be formed;

(c) preparing a second alloy of lead, antimony and tin; and (d) melting said second alloy and pouring said second alloy over said first alloy such that the particles of said first alloy are wetted by the molten second alloy to become suspended in a matrix of said second alloy.

11. The method according to claim 10 wherein step (a) comprises: melting the iron or steel, the ferrotungsten alloy and the carbon in an inert gas environment; and quenching the molten first alloy while avoiding phase segregation.

12. The method according to claim 10 further comprising the steps of sorting by size the particles formed in step (b) and utilizing in step (c) only particles smaller than a predetermined size.

13. The method according to claim 10 wherein step (c) includes heating a mixture of lead, antimony and tin to approximately 300° C. to cause the mixture to melt and alloy together homogeneously.

14. The method according to claim 10 further comprising the step of forming the material prepared in step (d) into shotgun pellets.

* * * * *